US005308220A

United States Patent [19]

Schaeff

[11] Patent Number: 5,308,220

[45] Date of Patent: May 3, 1994

[54] SCOOP-AND-DUMP JACK FOR SHOVEL-LOADER

[75] Inventor: Hans Schaeff, Langenburg, Fed. Rep. of Germany

[73] Assignee: Karl Schaeff GmbH & Co., Maschinenfabrik, Langenburg, Fed. Rep. of Germany

[21] Appl. No.: 935,809

[22] Filed: Aug. 27, 1992

[30] Foreign Application Priority Data

Aug. 30, 1991 [DE] Fed. Rep. of Germany ..... 4128959

[51] Int. Cl.[5] ..... E02F 3/00

[52] U.S. Cl. ..... 414/699; 91/1; 92/66; 92/5 R

[58] Field of Search ..... 414/685, 699, 700, 708, 414/715; 91/1; 92/166, 5 R

[56] References Cited

U.S. PATENT DOCUMENTS 2,719,404 10/1955 Hobson ..... 92/5 X
3,095,785 7/1963 Cahill ..... 91/1
3,505,929 4/1970 Coppola et al. ..... 91/1
4,414,881 11/1983 Devaud ..... 92/166 X
4,987,822 1/1991 Stoll ..... 91/1 X

*Primary Examiner*—Michael S. Huppert
*Assistant Examiner*—Donald W. Underwood
*Attorney, Agent, or Firm*—Shlesinger, Arkwright & Garvey

[57] ABSTRACT

The invention concerns a scoop-and-dump jack of a loader shovel or a fork of a shovel loader and comprising a piston-rod extension 46*a* guided in a sealed borehole of the jack cylinder-bottom 43 to achieve a dumping motion at least as rapid as the retracting motion and to permit simple assembly and maintenance of the jack, the diameter of said extension corresponding at least to that of the piston rod 46, the jack bearing-eye 50 and the jack cylinder-bottom being integrally joined by a connection member 49 extending over most of the length of advance of the piston-rod extension 46*a*, and the receiving space 51 for the piston-rod extension comprising a laterally open access for purposes of assembly or exchange of the guide means and seals 44, 45 in the jack cylinder-bottom.

19 Claims, 6 Drawing Sheets

SCOOP-AND-DUMP JACK FOR SHOVEL-LOADER

CROSS REFERENCE TO RELATED APPLICATIONS

This application claims the priority of German application no. P 41 28 959.5, filed Aug. 30, 1991, which is incorporated herein by reference.

FIELD OF THE INVENTION

The invention concerns a tipping cylinder or a scoop-and-dump jack for a shovel-loader's shovel of a construction vehicle and of which the jack-base is linked by a support eye to the loader chassis above a pivoting frame or operational truss and of which the piston rod is linked by a support eye to a drive lever resting on the operational truss in such manner that the loader shovel indirectly connected to the drive lever remains in an upwardly open pivoting position over the entire pivoting range of the operational truss while the length of the jack remains constant.

BACKGROUND OF THE INVENTION

It is known to control the pivoting motions of a loader shovel using parallelogram kinetics wherein the scoop-and-dump jack together with the operational truss, the loader chassis bearing the stationary link points and a drive lever displaceable along the operational truss form a parallelogram for at least one length of the jack. In order to enlarge the pivot-angle of the loader shovel, the drive lever is connected by a steering means with said shovel. For a particular parallelogram size, a loader shovel filled with dumping material retains its upward open pivoted position over the entire range of pivot motion of the operational truss. Even when the loader shovel is replaced by a stacking implement, the loaded material resting on the fork remains approximately parallel to its initial position over the entire pivoting path of the operational truss. The parallelogram kinetics entails the drawback that only the differential area of the jack piston will be hydraulically loaded when the loader shovel is retracted or when it is used to break out the material to be picked up. Moreover dumping is slower than retraction because the available oil flow must load all the jack cross-section when the loader shovel is being emptied by dumping.

On the other hand, as regards a so-called Z kinematics, the scoop-and-dump jack is connected at one end of the drive lever which in this case rests between its two ends and the loader shovel is connected by a control means to the other end. The rocker lever serves to so reverse the jack motions that to fill the loader shovel the entire piston area shall be available, but only the differential piston area will be for dumping. However this advantageous use of jack power also entails the drawback that the loader shovel or the fork of a forklift are not automatically kept parallel to the pivoting range of the operational truss and as a result the scoop-and-dump jack must be fine-controlled several times.

OBJECTS AND SUMMARY OF THE INVENTION

An object of the invention is to so design a scoop-and-dump jack of the initially described kind and used in parallelogram kinematics that it shall carry out faster than heretofore the loader-shovel dumping motion and will carry out the scooping motion at least as fast, the design changes so introduced making possible especially simple and reliable assembly and maintenance of the jack and increasing is resistance to bending loads.

The invention solves this problem in that

- the jack comprises a piston-rod extension guided inside a sealed borehole of the jack base, said piston-rod extension evincing a diameter corresponding at least to that of the piston rod and a length being at least that of the maximum piston stroke,
- the bearing eye of the jack and the jack base are integrally connected by a connection member tensionally and compressively resistant relative to the jack forces and extending over most of the maximum length of the piston-rod extension,
- and a central receiving space for the piston-rod extension being provided in the connection member, said space comprising open, lateral access for assembly or exchange of the piston-rod seals in the jack base.

Because the proposed design comprises a plain, mass-produced jack with a piston-rod extension passing through the jack base, the dumping time of the loader shovel is advantageously decreased by the reduced jack volume following from the piston-rod extension. The increased dumping speed of the loader shovel is exploited in desired, rationalized operation, for instance when loading trucks waiting at soil excavation sites are being loaded. Because the connection member protecting the piston-rod extension against external factors is welded to the jack base or is integral with it in some other way, a flange connection, which would be complex and would enlarge the diameter and the bulk, will be averted, bearing moreover in mind that the reliability of such a flange connection in the presence of the alternating tensions and compressions arising in the operation of the jack would depend on the care with which the flange bolts are affixed. The stress resistance of the jack regarding pressure and bending loads is substantially increased because the piston rod is guided on both sides of the piston in the jack's cylinder head and cylinder bottom. The laterally open access in the connection member is advantageous in several respects because making possible problem-free assembly and maintenance of the guide means, seals and wiper rings in the cylinder bottom that are subject to normal wear. Moreover the laterally open access allows viewing the piston-rod extension, so that the driver can ascertain any time by means of the particular position of said extension what the pivoted position of the loader shovel is. Again, the piston-rod extension can assume the function of an otherwise additionally mounted position-sensing linkage and by using sensors and controls, said extension may be used to automatically adjust the loader shovel.

In one embodiment, the connection member together with the bearing eye may assume the shape of a tuning fork, the fork legs being made of flat or shaped steel and being connected to the bearing eye and the cylinder bottom and containing the seat, i.e. the receiving space, for the piston-rod extension between said fork legs. In another embodiment the connection member may be a simple calcined, forged or cast part and be permanently welded to the jack's cylinder-end and where called for it may also be integral with the cylinder bottom. No special requirements are placed on the connection member regarding its surface treatment or its receiving space enclosing with play the piston-rod extension.

Appropriately the connection-member receiving space, which is open at least on one side, shall be provided with a detachable cover. Illustratively, in the case of the tuning-fork shape, at least one cover plate shall be detachable and allow access to the guide means and the seals in the cylinder bottom.

The diameter of the piston-rod extension may be different than that of the piston rod, and in the event the piston-rod diameter is less, this rod either may be turned from a uniform component or be connected, for instance by screwing, to the extension. The dumping speed can be arbitrarily raised relative to the loader-shovel scooping speed by suitably choosing the diameters.

In one variation the piston-rod extension forms a position sensing means for an electro-hydraulic control by means of which the cylinder displacement (pivoting motion of the loader shovel) shall be stopped in one and/or the other direction at a specified location which in particular with respect to its scooping position corresponds to the shovel base (evincing the scooping edge) being on the whole parallel to the plane of travel. The driver is thus enabled to apply the electro-hydraulic control whenever the loader shovel must be automatically pivoted from an arbitrary dumping position or also from an upward scooping position into the desired regular receiving position in the shortest possible time. Embodiment modes of the electro-hydraulic control for a scoop-and-dump jack of the invention are stated in the claims 8 through 11.

Illustrative embodiments of the invention are elucidated below in relation to the schematic drawings.

The construction vehicle according to the invention is referred to as a "shovel loader." The bucket-like part which holds the contents of a load is referred to as a "shovel" or "loader shovel." The "shovel loader device" or "shovel loader implement" is the "scoop-and-dump jack" in combination with the associated linkages and/or the "loader shovel."

DETAILED DESCRIPTION OF THE INVENTION

Figure 1A:
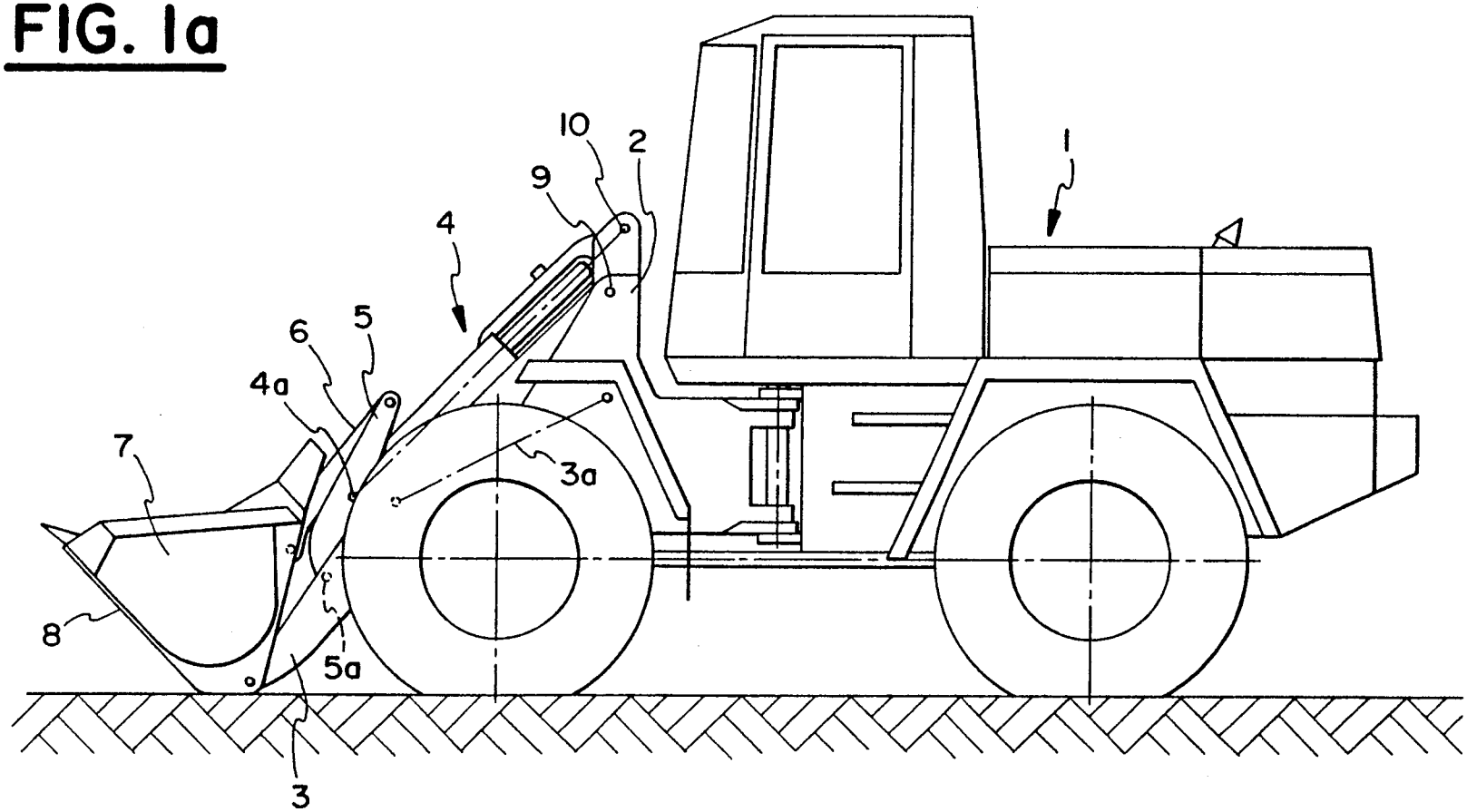
FIG. 1*a* shows a shovel loader with the scoop-and-dump jack of the invention, the loader shovel being in the retracted position.
Figure 1B:
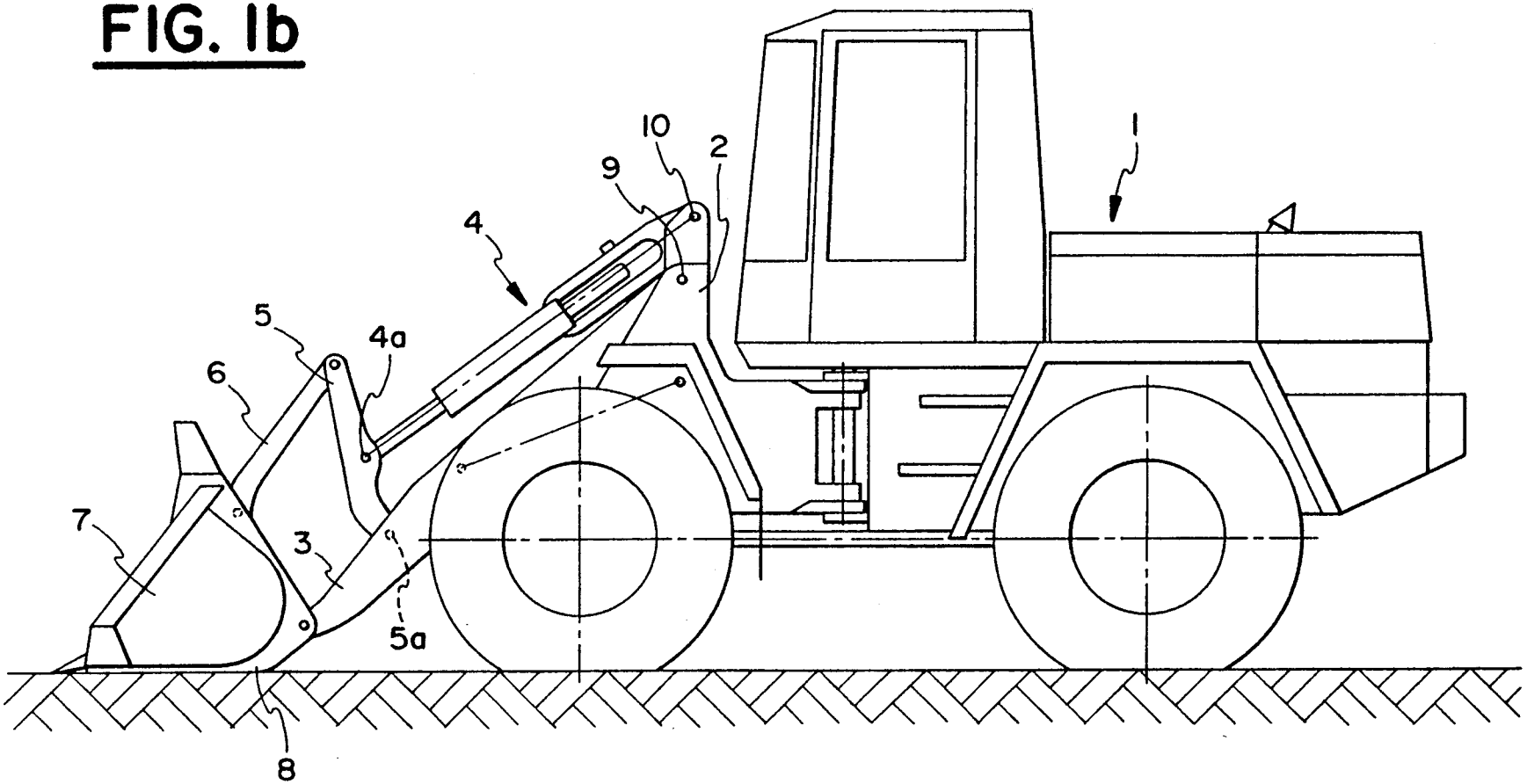
FIG. 1*b* is the shovel loader of FIG. 1*a* with the loader shovel pivoted into the scooping position in the travel plane.
Figure 1C:
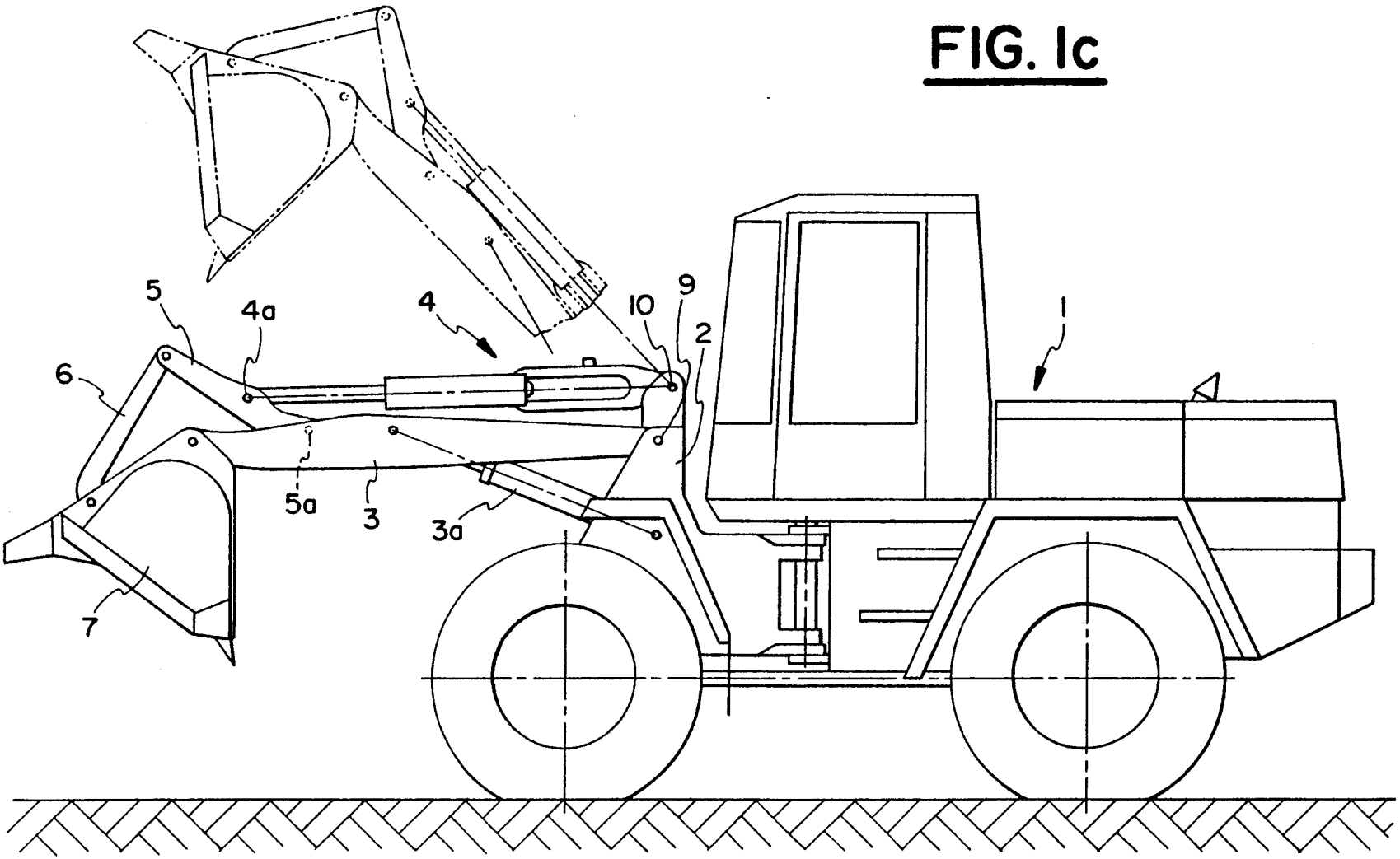
FIG. 1*c* shows a shovel loader of FIG. 1*a* in the dumping position with the operational truss pivoted into different heights.

As shown by FIGS. 1*a* through 1*c*, a loader chassis 2 is present on the front carriage of a shovel loader 1. An operational truss 3 is pivoted in the vertical plane by a drive jack 3*a* and rests on a bearing 9 in the loader chassis 2. A scoop-and-dump jack 4 is connected by its rear end to a bearing 10 in the chassis 2 and by its front end at 4*a* to a drive lever 5 pivotably attached at 5*a* in the operational truss 3 and connected by its other end by means of a link 6 to the loader shovel 7.

FIG. 1*b* shows the loader shovel 7 of which the base 8 is parallel on or above the plane of travel. In this scooping position, the piston rod of the scoop-and-dump jack 4 is advanced partly to approximately the mid position FIG. 1*c* shows the operational truss 3 actuated by the drive jack 3*a* when in two different pivoted positions wherein the loader shovel 7 with its advanced scoop-and-dump jack 4 has been moved into its dumping positions. Upon comparison it is noted that in the case of a retracted, i.e. upwardly open loader shovel 7 as shown in FIG. 1*a*, the scoop-and-dump jack 4 extends approximately parallel to a conceptual line connecting the bearing site 5*a* of the scoop-and-dump jack 4 at the operational truss 3 to the bearing 9 of said frame. At the same time conceptual lines connecting the bearing sites 9 to 10 on one hand and on the other the bearing sites 4*a* to 5*a* are essentially mutually parallel, and therefore in the light of the above described parallelogram relation, the retracted state of the loader shovel 7 is preserved over the entire pivoting range of the operational truss 3. This parallelogram relation is absent from the shovel positions of FIGS. 1*b* or 1*c* because the direction of the scoop-and-dump jack 4 deviates in FIG. 1*b* from the direction of the operational truss or because, as regards FIG. 1*c*, the connecting line 4*a*–5*a* points in a different direction than the connecting line 9–10 at the loader chassis 2.

Figure 2A:
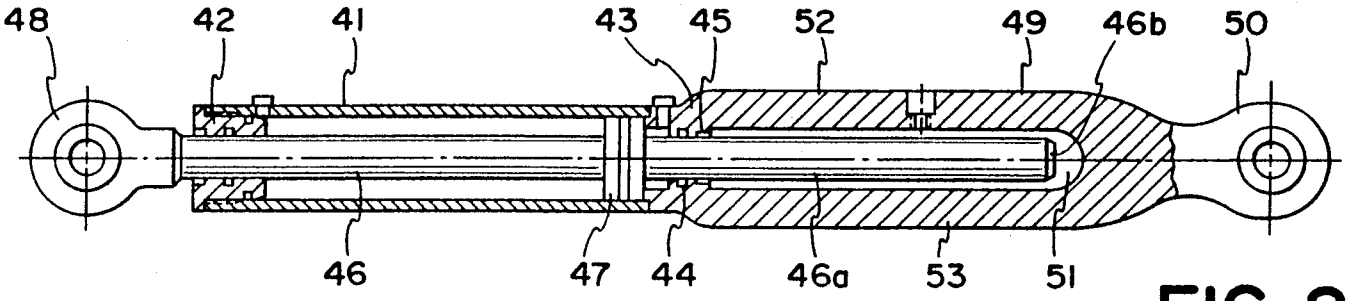
FIG. 2*a* shows a partial section of a scoop-and-dump jack of the invention with retracted piston rod.
Figure 2B:
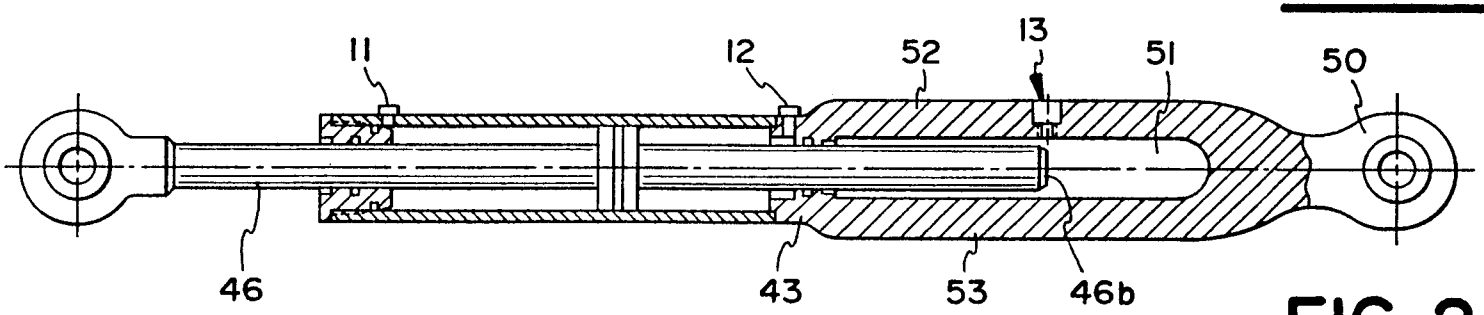
FIG. 2*b* shows the scoop-and-dump jack of FIG. 2*a* with the piston rod advanced midway corresponding to the scooping position of the loader shovel of FIG. 1.
Figure 2C:
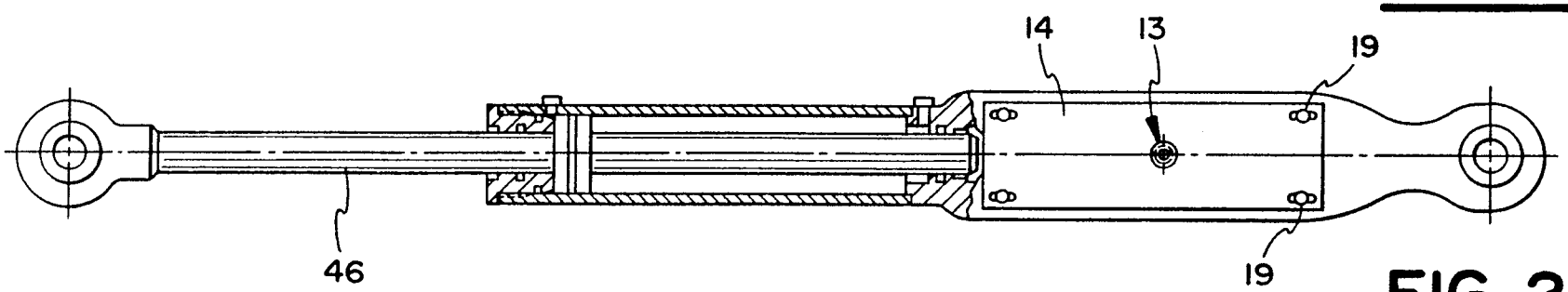
FIG. 2*c* shows the scoop-and-dump jack with fully advanced piston rod corresponding to the dumping position of the loader shovel, the lateral access in the connection member being sealed by a cover plate.

The scoop-and-dump jack used for the shovel loader is detailed in FIGS. 2*a* through 2*c*. It comprises a cylinder tube; i.e., case 41 with a cylinder head 42 and conventional seals. The cylinder head 42 is detachably mounted to the cylinder tube 41 and a cylinder base 43 is welded into the other end of the cylinder tube, i.e., case 41 and preferably shall be a stationary component of a connection member 49 fitted with a bearing eye 50. Seals 44 and wiper rings 45 to seal an extended piston-rod segment 46*a* (and where called for an omitted guide means) are present in the cylinder base 43.

A piston 47 with piston seals is mounted on the piston rod 46 which together with the piston-rod extension 46*a* passing through the cylinder bottom 43 may form one integral component. The piston-rod end projecting through the cylinder head 42 supports a screwed-on or welded-on bearing eye 48 depending on the piston 47 being mounted detachably or undetachably to the piston rod 46. The free end of the piston-rod extension 46*a* may comprise a ride bevel 46*b* which is discussed further in relation to FIG. 3. The piston rod 46 and its extension 46*a* may be of the same or of different diameters. The actual hydraulic jack bounded by the cylinder head 42 and the cylinder bottom 43 comprises hydraulic hookups 11 and 12 at the two ends.

The connection member 49 extending the jack 4 on the side of its cylinder bottom 43 serves to support the jack, i.e., to transmit the forces into the loader chassis 2 and at the same time protects the piston-rod extension 46a. For that purpose the fork-shaped connection member 49 comprises a seat, i.e., receiving space 51 between its parallel legs 52, 53, which encloses with clearance the piston-rod extension 46a shown fully retracted in FIG. 2a. The seat 51 is open on at least one side, making it possible thereby, in the case of disassembled piston rod, to assemble, or to exchange through the open access to the seat 51, the seal 44 and the wiper ring 45 in the cylinder bottom. The connection member 49, which is integral with the bearing eye 50, may be flat and have the shape of a tuning fork, as a result of which the receiving space 51 is open on both sides and may be closed by detachable cover plates protecting the piston-rod extension 46a and its guide means and seals. The connection member 49, which may be manufactured as a forged or cast part, or from flat steel by receiving its contoures by gas or flame cutting, also may evince other shapes, for instance that of a tube or flask, respectively cut open or beveled on one side to form the lateral aperture of the receiving space 51. Preferably and as shown, the machined cylinder bottom 43 forms one unit with the legs 52, 53 by means of welding or other connection means.

The semi-advanced position of the jack shown in FIG. 2b approximately corresponds to that of FIG. 1b wherein the loader shovel 7 assumes its scooping position with the shovel base 8 resting on the ground. The wholly advanced position of jack shown in FIG. 2c corresponds to that of the of FIG. 1c, wherein the loader shovel assumes its dumping position. The cover 14 may serve as a seat for an electric sensor 13 discussed further below and projecting into the path of the piston-rod extension 46. The screw-detachable cover 14 is to some degree adjustable in length by means of the elongated slots 19 indicated in FIG. 2c.

Figure 3:
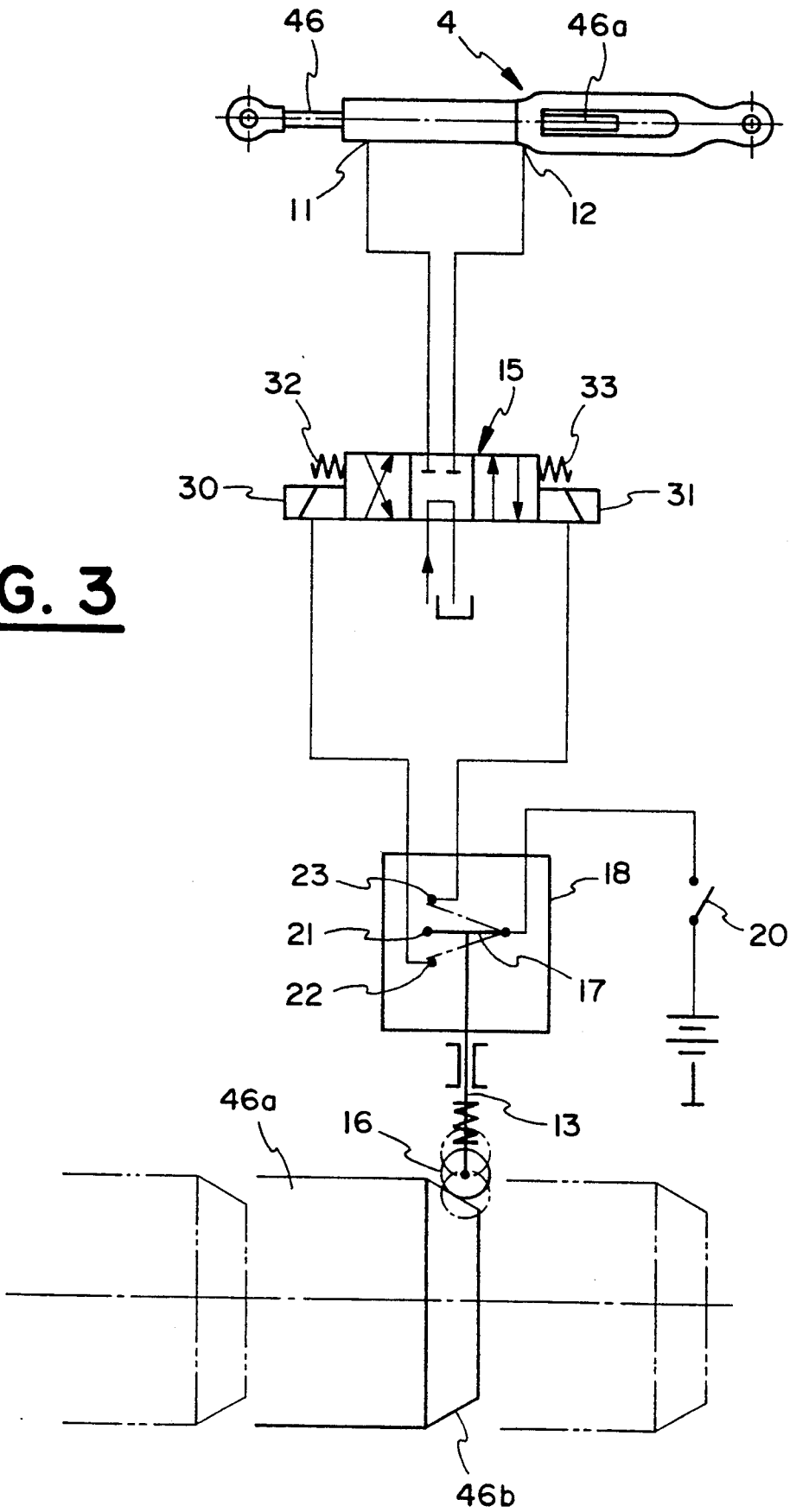
FIG. 3 is an electro-hydraulic circuit diagram of the automatic control for a scoop-and-dump jack using an electrical sensor.

As shown by FIG. 3, a spring-loaded electric sensor 13 rests by a front sensing roller 16 against the ride bevel 46b of the piston-rod extension 46a which is shown in two further intermediate positions. The electric sensor is connected in such a way to a reversible contact blade 17 of a two-pole switch 18 that in the shown center position it will not drive an electromagnetic switching valve 15, i.e., its electromagnets 30, 31 otherwise controlled from the switch 18. This electro-hydraulic control of the scoop-and-dump jack serves to achieve automatic shovel return into the scooping position (FIG. 1b) and is implemented by a switch 20. If the power supply is interrupted, the switching valve 15 assumes a center blocking position determined by its springs 32, 33. When, after the loader shovel was dumped clear of its contents (FIGS. 1c, 2c), the automatic shovel return is activated at the switch 20, then the sensor 13 will assume its lower limit position. As a result, the contacts 21, 22 close, the magnet 30 is energized and the switching valve 15 of FIG. 3 is moved leftward so that the cylinder hookup is supplied with oil and the piston rod 46 is retracted until the piston-rod extension 46a assumes the position shown in solid lines in FIG. 3 (i.e., the jack condition of FIGS. 1b, 2b), thereby interrupting the electrical circuit and locking the scoop-and-dump jack 4.

With the scoop-and-dump jack fully retracted as shown in FIG. 1a, and the switch 20 being actuated, the electrical sensor 13 resting on the piston-rod extension 46a closes the contacts 21–23 and energizes the electromagnet 31 which then switches the compressed oil supply at the valve 15 to the hookup 12 of the scoop-and-dump jack 4.

As a result the jack's piston rod 46 is advanced until the piston-rod extension 46a arrives in the position shown by solid lines in FIG. 3. Independently of the scoop-and-dump jack 4, the drive jack 3a is then driven by an arbitrarily controlled valve. As long as the switch 20 is OFF, the scoop-and-dump jack can be controlled by the valve 15 or a valve connected in parallel with it.

Figure 4:
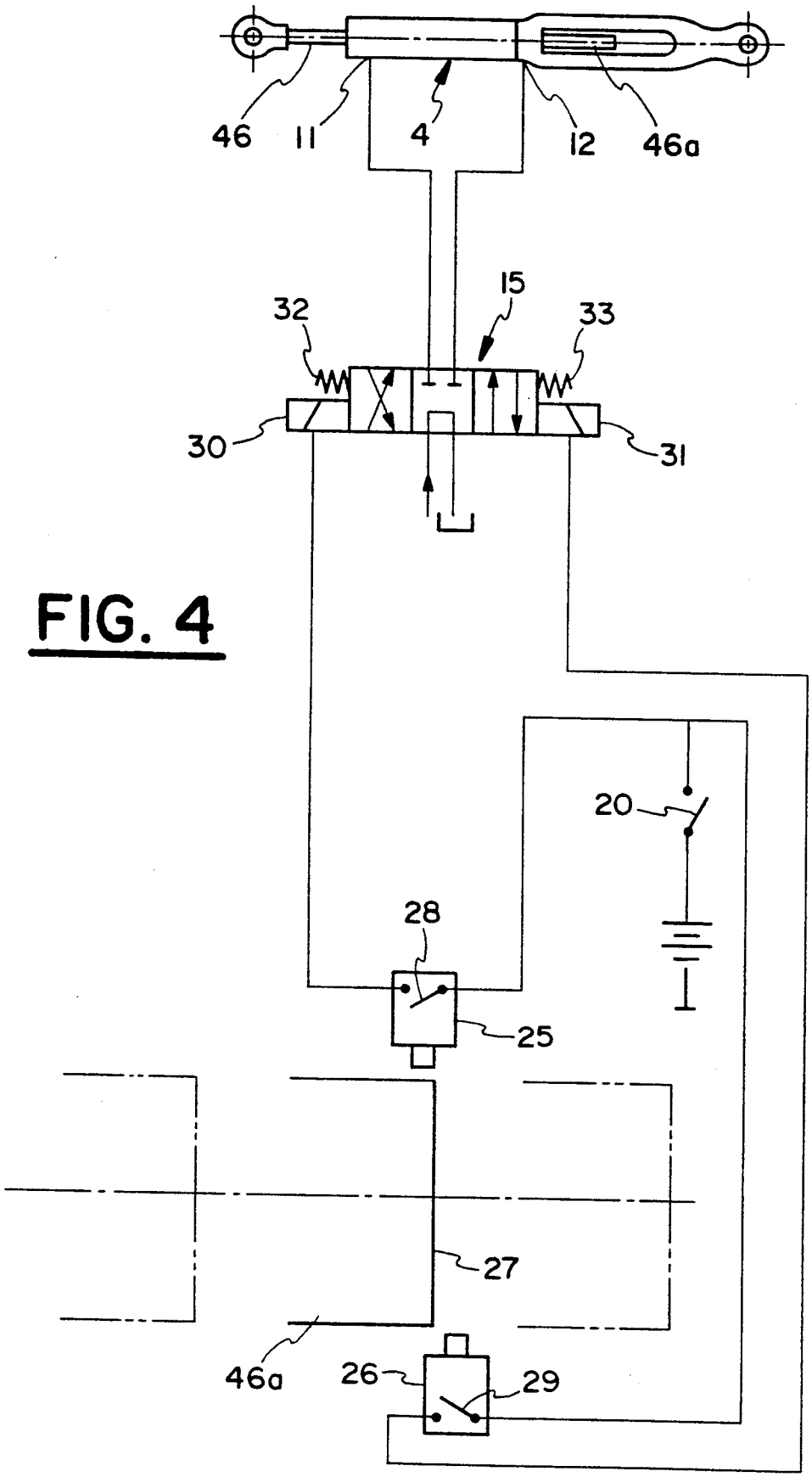
FIG. 4 shows an electro-hydraulic control for a scoop-and-dump jack of which the design was changed by using a proximity switch.

As shown by FIG. 4, two contact-less proximity switches 25, 26 are provided in the electro-hydraulic control of automatic shovel-return into the scooping position at the connection link 49 or at one or two mutually opposite cover means 14, and cooperate with a control edge 27 of the piston-rod extension 46. The proximity switch 25 includes an opening contact 28 and is offset by a slight distance toward the cylinder bottom 43 from the proximity switch 26 which includes a closing contact 29. In order to automatically transfer the shovel either from the retracted position of FIG. 1a or from the dumping position of FIG. 1c into the scooping position of FIG. 1b, the control is initiated by actuating the switch 20.

If now the control edge 27 is in the position indicated on the left in FIG. 4, then the electromagnet 30 shall be energized through the normally closed opening contact 28 of the switch 25. The magnet 30 pulls the switching valve 15 against the opposition of its centering springs 32, 33 to the left, and thereby the hookup 11 of the jack 4 is fed with pressurized oil until the control edge 27 interrupts the power in the position at the switch 25 shown by the solid lines (jack condition of FIGS. 1b, 2b) by means of the opening contact 28. During the automatic return of the piston-rod extension 46a from a position indicated on the right in FIG. 4, the normally open closing contact 29 of the proximity switch 26 remains closed, as a result of which the electromagnet 31 is energized and the switching valve 15 is pulled to the right against the force of the centering springs 32, 33, pressurized oil being fed to the hookup 12 of the jack 4 until the control edge 27 has moved out of range of the switch 26 of which the contact 29 then opens and hence the switching valve 15 arrives into the shown, centered blocking position.

What is claimed is:

1. A shovel loader device including a scoop-and-dump jack in combination with a loader shovel for a construction vehicle, the jack having a case and a cylinder-bottom, the cylinder-bottom hinges by a bearing eye on a loader chassis above a pivotable operational truss, and a piston rod which hinges by means of a bearing eye on a rocker lever attached to the operational truss, in such a manner that the loader shovel indirectly linked to the scoop-and-dump jack remains in an upwardly open pivoted position over the entire pivoting range of the operational truss while the length of the jack remains constant, the combination of said loader shovel and said scoop-and-dump jack wherein:

a) the jack comprises a piston-rod extension guided inside a sealed borehole of the jack cylinder-bottom, the diameter of said extension corresponding at least to that of the piston rod and of which the length corresponds at least to that of the maximum piston stroke;

b) the jack bearing-eye and the jack cylinder-bottom are integrally connected by a connection member extending across most of the length of the movement of the piston-rod extension and tensionally and compressively resistant to the jack forces; and c) a central receiving space for the piston-rod extension being present in the connection member, which comprises a laterally open access for assembly and exchange of piston-rod seals in the jack cylinder-bottom.

2. The shovel loader device as defined in claim 1, wherein the connection member comprises two parallel legs which together with the jack bearing eye is shaped like a tuning fork and the receiving space for the piston-rod extension is in the form of the gap between the legs of which the ends are welded to the jack cylinder-bottom.

3. The shovel loader device as defined in claim 1, wherein the connection member along with the bearing eye is made by one of forging, casting, or cutting.

4. The shovel loader device as defined in claim 1, wherein the lateral open access of the connection member is open at least on one side between the jack cylinder-bottom and the bearing eye, and the jack comprises a detachable cover for the open access.

5. The shovel loader device as defined in claim 1, wherein the piston-rod extension has a larger diameter than the piston rod.

6. The shovel loader device as defined in claim 1, wherein the connection member is welded to the jack case.

7. The shovel loader device as defined in claim 1, wherein the piston-rod extension forms an actuator for a piston sensor attached to the connection member for an electrohydraulic control and initiates jack displacement for a loader-shovel's scooping and dumping motion and stops at a specific position preferably corresponding to the shovel scooping position with a bottom wall of the shovel parallel to the plane of travel.

8. The shovel loader device as defined in claim 7, wherein the position sensor is an electric sensor provided on the connection member and projecting at a predetermined location into the path of the piston-rod extension, the free end of said extension comprising a ride bevel holding the electric sensor in a central position and the electric sensor is so connected to a contact blade of a two-pole switch that it remains OFF in its center position but when in its two end positions will drive the scoop-and-dump jack by means of an electric switching valve into displacement in either of the mutually opposite directions.

9. The shovel loader device as defined in claim 7, wherein the position sensor comprises at least one contactless proximity switch to reverse, as a function of displacement, a switching valve controlling the scoop-and-dump jack, the at least one proximity switch being positioned adjacent the extended piston-rod segment along its displacement path in the connection member.

10. The shovel loader device as defined in claim 9, wherein the position sensor comprises at least two proximity switches, one said proximity switch contains an opening contact, and the other said proximity switch contains a closing contact, a control edge of the piston-rod extension at the connection member cooperates with said one proximity switch containing an opening contact to control one of two electromagnets of the switching valve and further with said other proximity switch containing a closing contact to control the other electromagnet, said one proximity switch containing an opening contact and said other proximity switch containing a closing contact being slightly mutually offset in the direction of displacement of the control edge.

11. The shovel loader device as defined in claim 7, wherein the position sensor of the electrohydraulic control is mounted on a cover means mounted over the open access of the connection member, the cover means being affixed in an adjustable manner through longitudinally elongated slots located thereon.

12. A shovel loader device, comprising:

a) a loader shovel;

b) a scoop-and-dump jack attached to said loader shovel;

c) said scoop-and-dump jack including:

i) a cylinder having a cylinder bottom;

ii) a piston rod disposed in said cylinder;

iii) a piston rod extension attached to said piston rod and extending through said cylinder bottom;

iv) a jack bearing-eye spaced from said cylinder bottom;

v) a connection member disposed between said cylinder bottom and said jack bearing eye;

vi) said connection member having a central receiving space for receiving said piston rod extension;

vii) said central receiving space being sufficiently long for receiving substantially the entire piston rod extension; and viii) said central receiving space comprising an opening located adjacent to said cylinder bottom and sized to permit lateral access to said cylinder bottom.

13. The shovel loader device as defined in claim 12, wherein:

a) said connection member includes two legs.

14. The shovel loader device as defined in claim 12, wherein:

a) a detachable cover sized and shaped for substantially covering said central receiving space is detachably disposed on said connection member.

15. The shovel loader device as defined in claim 12, wherein:

a) said cylinder bottom is substantially integral with both said connection member and said cylinder.

16. A scoop-and-dump jack for use with a shovel loader device, said scoop-and-dump jack comprising:

a) a cyliner having a cylinder bottom;

b) a piston rod disposed in said cylinder;

c) a piston rod extension attached to said piston rod and extending through said cylinder bottom;

d) a jack bearing-eye spaced from said cylinder bottom;

e) a connection member disposed between said cylinder bottom and said jack bearing-eye;

f) said connection member having a central receiving space for receiving said piston rod extension;

g) said central receiving space being sufficiently long for receiving substantially the entire piston rod extension; and h) said central receiving space comprising an opening located adjacent to said cylinder bottom and sized to permit lateral access to said cylinder bottom.

17. The scoop-and-dump jack as defined in claim 16, wherein:

a) said connection member includes two legs.

18. The scoop-and-dump jack as defined in claim 16, wherein:

a) a detachable cover sized and shaped for substantially covering said central receiving space is detachably disposed on said connection member.

19. The scoop-and-dump jack as defined in claim 16, wherein:

a) said cylinder bottom is substantially integral with both said connection member and said cylinder.

* * * * *